US008584686B2

(12) United States Patent
Polanish

(10) Patent No.: US 8,584,686 B2
(45) Date of Patent: Nov. 19, 2013

(54) FOAM APPLICATORS TO APPLY COSMETICS OR NAIL POLISH

(75) Inventor: Eugene Polanish, Monroe, CT (US)

(73) Assignee: Advanced Enterprises Inc., Middletown, NY (US)

( * ) Notice: Subject to any disclaimer, the term of this patent is extended or adjusted under 35 U.S.C. 154(b) by 0 days.

(21) Appl. No.: 13/490,004

(22) Filed: Jun. 6, 2012

(65) Prior Publication Data

US 2012/0298131 A1 Nov. 29, 2012

Related U.S. Application Data

(63) Continuation-in-part of application No. 12/772,397, filed on May 3, 2010, now abandoned.

(60) Provisional application No. 61/294,255, filed on Jan. 20, 2010.

(51) Int. Cl.
*A45D 40/26* (2006.01)
*A45D 40/24* (2006.01)

(52) U.S. Cl.
USPC ..... 132/320; 132/317

(58) Field of Classification Search
USPC ..... 132/73, 74.5, 317, 320; D28/7, 56; 15/244.4; 401/130
See application file for complete search history.

(56) References Cited

U.S. PATENT DOCUMENTS 2,265,274 A 12/1941 Elliott
2,517,283 A * 8/1950 Bryant ..... 401/198
2,550,890 A * 5/1951 Vaughn ..... 132/74.5
4,101,053 A 7/1978 Mast, Jr.
4,944,318 A 7/1990 Gaylord et al.
5,983,902 A 11/1999 Heneghan
6,013,344 A 1/2000 Corbins
6,033,143 A 3/2000 Gueret
6,062,234 A 5/2000 Finocchiaro
6,119,704 A 9/2000 Bouchat et al.
6,168,434 B1 1/2001 Bohm-Van Diggelen
6,220,254 B1 * 4/2001 Gueret ..... 132/313
6,312,181 B1 11/2001 Joulia
6,601,591 B1 * 8/2003 Carullo et al. ..... 132/320
6,666,216 B2 12/2003 Bourjal
7,108,440 B1 9/2006 Gruenbacher
7,219,801 B2 5/2007 Christian
2004/0089320 A1 * 5/2004 Williams et al. ..... 132/320
2005/0045201 A1 3/2005 Williams (Continued)

OTHER PUBLICATIONS

Wonder Products, Advanced Enterprises, Inc., http://www.wondercloth.com/content/default.asp.

(Continued)

*Primary Examiner* — Niyati D Shah
(74) *Attorney, Agent, or Firm* — Hess Patent law Firm LLC; Robert J. Hess

(57) ABSTRACT

A cosmetic foam applicator product applies cosmetics to the skin and a nail polish foam applicator applies nail polish to fingernails and toenails. Each foam applicator has a stem and an adjacent head. The stem for the cosmetic foam applicator has sidewalls contoured as finger grips and its head has elongated tips that extend away from the stem. The relative length of the tips determines whether the cosmetic foam applicator is soft tipped, firm tipped or medium (soft or firm) tipped. The stem for the nail polish foam applicator has parallel straight sidewalls and its head has a bulge with an elongated tip that extends from the bulge.

10 Claims, 5 Drawing Sheets

(56) References Cited

U.S. PATENT DOCUMENTS

| | | | | |
|---|---|---|---|---|
| 2006/0162735 | A1* | 7/2006 | Thiebaut | 132/200 |
| 2006/0188850 | A1* | 8/2006 | Mills | 434/100 |
| 2006/0243291 | A1 | 11/2006 | Daley | |
| 2006/0249168 | A1 | 11/2006 | Smit | |
| 2008/0105580 | A1 | 5/2008 | Nentwick | |
| 2008/0295858 | A1 | 12/2008 | Dobler | |

OTHER PUBLICATIONS

Wonder Wedge, Advanced Enterprises, Inc., http://www.wondercloth.com/content/estore_details.asp?product=3.
Wonder Puff, Advanced Enterprises, Inc., http://www.wondercloth.com/content/estore_details.asp?product=7.
Wonder Rounds, Advanced Enterprises, Inc., http://www.wondercloth.com/content/estore_details.asp?product=5.

* cited by examiner

FOAM APPLICATORS TO APPLY COSMETICS OR NAIL POLISH

CROSS REFERENCE TO COPENDING PATENT APPLICATIONS

This application is a continuation-in-part of U.S. Ser. No. 12/772,397 filed May 3, 2010 and claims the benefit of priority from U.S. provisional patent application Ser. No. 61/294,255 filed Jan. 22, 2010.

BACKGROUND OF THE INVENTION

1. Field of the Invention

The invention relates to foam applicators to apply cosmetics to skin or nail polish to the fingernails and/or toenails.

2. Discussion of Related Art

The inventor is the owner of Advanced Enterprises, Inc., which is in the business of manufacturing cosmetic foam make-up applicators for women to apply liquid foundation, make-up, blush, eye shadow, concealer and other types of cosmetics to their skin.

Advanced Enterprises, Inc. is the manufacturer of a product line of cosmetic accessories and applicators that include cosmetic wedges, rounds, puffs, removers, and red rubber sponges; an assortment of sizes, shapes and materials of make-up applicators, powder puffs and specialty items. Advanced Enterprises, Inc. introduced the cosmetic wedges to the marketplace over 15 years ago and, in 1999, introduced the make-up remover cloth that removes make-up instantly upon contact, while gently exfoliating the skin. The make-up remover cloth is all natural, has a soft, velvety feel, and rinses completely clean in water—no stains remain and may be reused again and again.

Conventional make-up brushes carry bacteria from the skin into the make-up, allowing the bacteria to grow inside the make-up as well as on the brush. This bacteria is then transferred back to the skin when the make-up brush is used again. This bacteria can cause skin irritations which can lead to serious skin and eye infections.

It would be desirable to provide cosmetic applicators that avoid carrying bacteria from the skin into make-up, thereby preventing the growth of bacteria inside the make-up as well as on the brush.

SUMMARY OF THE INVENTION

One aspect of the invention resides in a foam applicator of cosmetics. The foam applicator may apply liquid foundation, make-up, blush, eye shadow, concealer and other types of cosmetics to skin, as well as loose powder and mineral make-up.

Preferably, the foam applicator has a stem whose sidewalls enable finger grips and has a head adjacent the stem with tips that are spaced apart from each other. The tips are configured to pick up the loose powder and spread the powder and mineral make-up evenly over the face. The foam applicator may be used like a brush without the negative aspects of standard cosmetic bristle brushes. Each head may have four or five tips.

A strip of foam may be die cut for forming a plurality of the foam applicators that may be manually separated from each other. While forming the strip, adjacent ones of the foam applicators may be retained to each other along side surfaces of outward ones of the tips. Side surfaces of the stems may be concavely curved or inclined or diverge toward the end of the stem.

BRIEF DESCRIPTION OF THE DRAWING

For a better understanding of the present invention, reference is made to the following description and accompanying drawings, while the scope of the invention is set forth in the appended claims.

DESCRIPTION OF THE PREFERRED EMBODIMENT

Figure 1A:
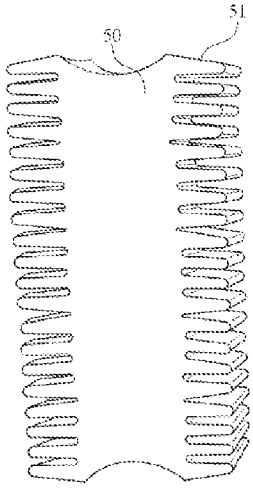
FIGS. 1A, 1B, and 1C are front views of three different size groups of cosmetic applicators each in a laid down orientation.
Figure 1B:
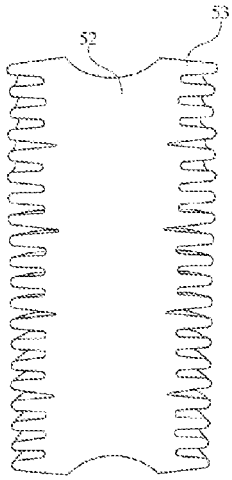
Figure 1C:
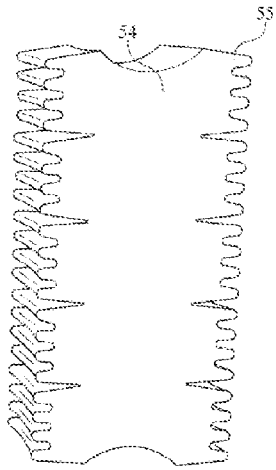
Figure 2A:
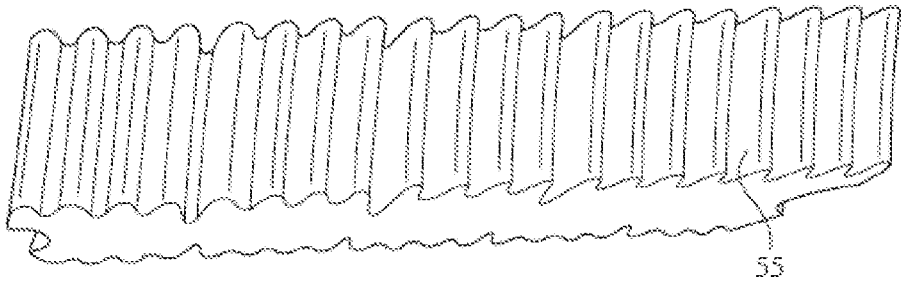
FIGS. 2A, 2B and 2C are top views of the three different size groups of cosmetic applicators of FIG. 1.
Figure 2B:
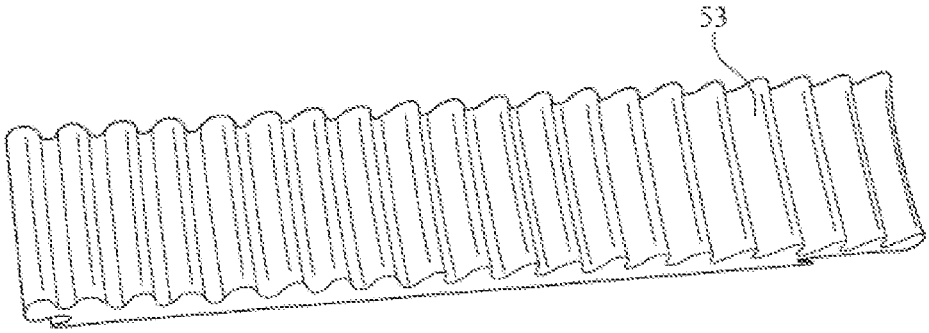
Figure 2C:
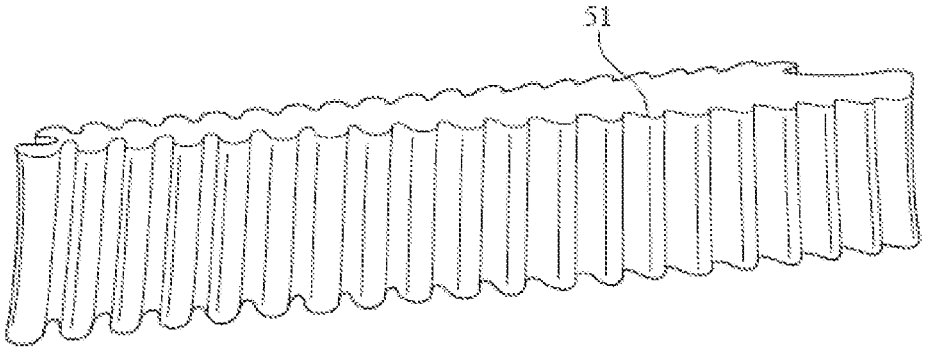

The foam applicator of any of the embodiments of the present invention is naturally hypoallergenic, biodegradable, anti-bacterial and is latex free. Such contrasts with conventional cosmetic brushes that promote the spread of bacteria and other contaminants or pollutants to the facial skin. Such conventional cosmetic brushes typically promote the spread of bacteria into the make-up and then transfers the bacteria to the skin, which can lead to skin irritations or worse health problems caused by infections that result.

In addition, the foam applicator of any of the embodiments of the present invention may be disposed of after use to completely eliminate the risk of transferring bacteria to the skin if reused. As such, it is a safe and inexpensive alternative to conventional cosmetic brushes that typically are reused.

To use the foam applicator of any of the embodiments of the present invention, the following steps may be carried out:

(1) Hold the stem of the foam applicator between the index finger and thumb. That is, hold at the concave surfaces of the stem or at the inclined surfaces of the stem as the case may be.

(2) Dip the foam tips onto the loose powder make-up, foundation, concealer, blush and pressed powder.

(3) Wisp the foam applicator in the desired areas until the make-up is looking smoother, even and flawless.

(4) Apply the make-up to hard to reach places, such as around the nose and under and over the eyes and around the lips and mouth, by positioning the tips to contact such hard to reach places.

(5) Carry out a stippling technique for applying make-up by using a rounded end. The rounded end may be at the opposite end from the tips for some of he embodiments (see the foam applicators 1 and 5 of FIGS. 1-5) or may be the rounded sides of the elliptical piece wedge 26 of FIGS. 23 and 24. Indeed, providing the user with both a foam applicator that has elongated tips and either a foam applicator or piece having a rounded side or end allows the user who applies the make-up with versatility for all types of make-up.

The present invention is directed at a foam applicator product. The product includes a pad with separation lines that define contours of a plurality of abutting pairs of cosmetic applicators and contours of a plurality of wedges. Neighboring ones of the abutting pairs of cosmetic applicators are separated from each other by a respective one of the wedges whose contour that faces the neighboring ones of the abutting pairs of the cosmetic applicators complements contours of the neighboring ones of the abutting pairs of the cosmetic applicators and face the respective wedge.

Each of the cosmetic applicators has a respective body defined by a stem and a head that are adjacent each other. The head has elongated applicator tips that are spaced apart from each other and extend away from the stem to terminate at distal ends. The stem has stem sidewalls that converge away from the head to terminate at a proximate end. The proximal end having a width across that is shorter than a width across the head, the proximal end of the stem of associated ones of the abutting pairs of the cosmetic applicators abutting each other.

The wedges each have opposite wedge ends between which extend opposite wedge sidewalls, The opposite wedge sidewalls diverge outwardly from each of the opposite wedge ends. Each of the cosmetic applicators is made of closed cell nonwoven material that tends to cling across the separation lines until being manually separated from each other. Each of the wedges has a length that spans between the wedge ends and that is longer than individual ones of the stems that neighbor the wedges.

Each of the cosmetic applicators is deformable under manual force from a relaxed, non-tensioned state to a deformed, tensioned state and configured because of the memory to resiliently return to the relaxed, non-tensioned state from the deformed, tensioned state once the manual force is removed. The stem sidewalls are concavely curved and the wedge sidewalls are convexly curved.

The closed foam material may be selected from styrene butadiene polymer synthetic foam and nitrile butadiene polymer synthetic foam.

The choice of soft, firm, medium (or intermediate) tipped foam applicators depends upon the desired application, although the shapes of each help the make-up to go on smoothly and evenly to create a beautiful, bacteria free natural glow from the cosmetic being applied. If the foam applicators are to be reused, they should be kept bacteria free by washing after use with mild soap and warm water. However, they are disposable, because they are so economical and eco friendly. For applying make-up, apply a neutral base color all over the eyelid (from lash line to brow) and apply medium shadow color on the lower eyelid (from lash line to the crease).

FIGS. 1A, 2A, 3A, 4A, 5A, FIGS. 1B, 2B, 3B, 4B, 5B, and FIGS. 1C, 2C, 3C, 4C, 5C show three different size cosmetic applicators 50, 52, 54. They differ from each other as to the length of their applicator tips 51, 53, 55. The shorter the length of the applicator tip, the more firm it feels to the touch since it is more resistant to flexing movement than for the longer applicator tips, which flex more readily to provide more softer feel. For ease in understanding, a length dimension runs from a proximal end 60 of the stem 62 of the cosmetic applicator to the distal ends of the applicator tips 51, 53, 55. A width dimension runs across the stem 62 or across the head 64 as the case may be. A depth dimension runs between opposite faces of the cosmetic applicator and may be considered the thickness.

Figures 3A, 3B, 3C:
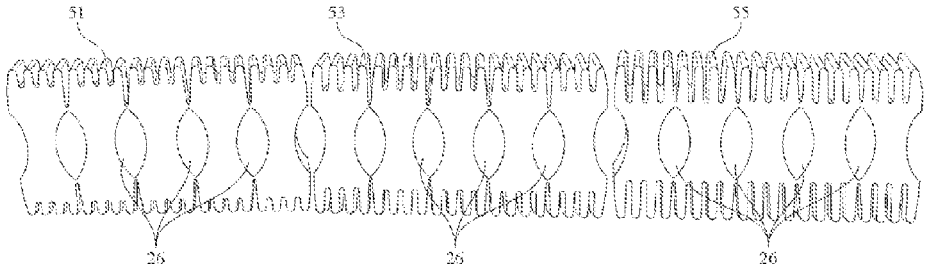
FIGS. 3A, 3B and 3C are end views of the-three different size groups of cosmetic applicators of FIGS. 2A, 2B and 2C.
Figure 4A:
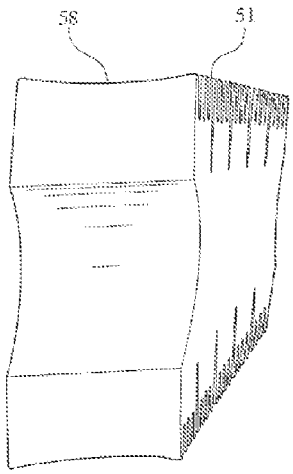
FIGS. 4A, 4B and 4C are front views as in FIGS. 1A, 1B and 1C, but with each of the different size groups of cosmetic applicators standing in an upright orientation.
Figure 4B:
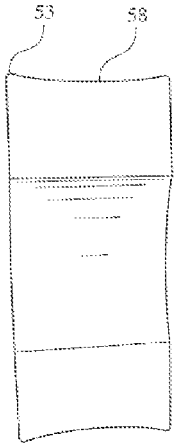
Figure 4C:
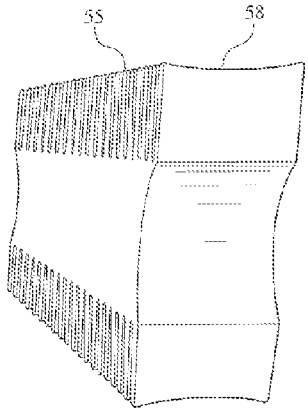
Figure 5A:
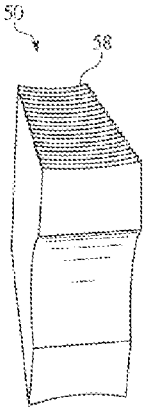
FIGS. 5A, 5B and 5C are standing upright orientation views of the three different size groups of cosmetic applicators of FIGS. 1A, 1B and 1C, but with one standing upright upon all of its tips on a bottom side lengthwise and two standing upright upon their ends.
Figure 5B:
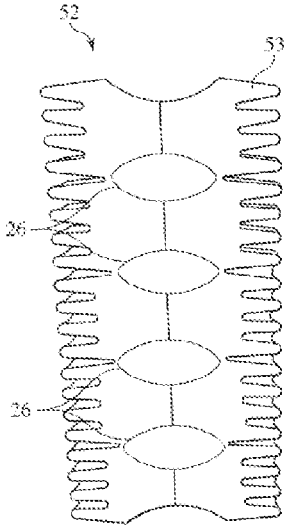
Figure 5C:
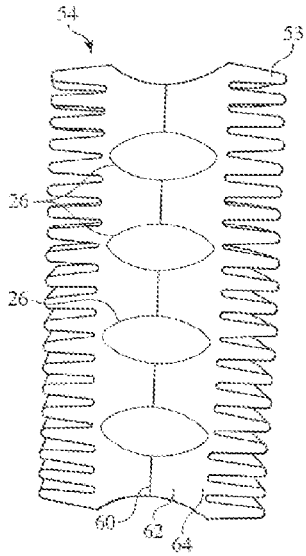

As best seen in FIG. 3A, 3B and 3C, each of the applicator tips of the cosmetic applicators have their own concave curvature 58 across the full dimension of their depths to face outwardly and better conform to the curvature of the human cheek to which the cosmetic applicator tips are to apply cosmetics. As a result, the spreading of the cosmetic is more uniform across the check in a single stroke that would be the case if there were a straight edge across the width instead of concave curvature. The distal ends of the applicator tips are rounded or flattened to be less susceptible to breakage than for pointed tips. Each group of the cosmetic applicators of may be packaged in a common package together with an insert that makes an indication of the cosmetic applicator as a function of a length of the applicator tips, the indication being selected from a group consisting of soft tipped, medium tipped and firm tipped. The individual cosmetic applicators of FIGS. 1A, 2A, 3A, 4A, 5A, FIGS. 1B, 2B, 3B, 4B, 5B, and FIGS. 1C, 2C, 3C, 4C, 5C separate from each other because of die cuts made into a solid foam material that shape the individual cosmetic applicators.

The cosmetic applicator of each of the embodiments of FIGS. 1A, 2A, 3A, 4A, 5A, FIGS. 1B, 2B, 3B, 4B, 5B, and FIGS. 1C, 2C, 3C, 4C, 5C does not have any access openings, such as would be for insertion of fingertips, and is thus uniform density across an entirety of the stem. The length from the proximal end of the stem of the soft and medium cosmetic applicators 52, 54 to the valleys between neighboring applicator tips is shorter than an adult human fingertip (from the end of the index finger to the first finger bend). Such a length for the firm cosmetic applicator 50 is just slightly larger than the adult human fingertip (just over one inch). The length the stem for each of the embodiments 50, 52 and 54 is shorter than the length of an adult human fingertip (less than one inch).

The formation of the cosmetic applicators of FIGS. 1A, 2A, 3A, 4A, 5A, FIGS. 1B, 2B, 3B, 4B, 5B, and FIGS. 1C, 2C, 3C, 4C, 5C entails die-cutting a strip of foam material to form the shape of the individual cosmetic applicators by forming separation lines, thereby leaving elliptical piece wedges 26 (or wedges) to be separated that form no part of the separated cosmetic applicators at the separation lines under manual force. The proximal ends of pairs of individual cosmetic applicators abut each other from the original strip of foam material after the die-cut.

The head of the cosmetic applicator includes a base from which extends the respective distance each being either smaller than, longer than or applicator tips that each traverse a respective distance until terminating at associated ones of the distal ends, the substantially as long as the length of the stem.

There are pairs of cosmetic applicators formed along the length of the strip of foam material whose proximal ends of their stems abut each other so that the stem length of each is less than one inch, which the inventor found is sufficient for a user to grasp the stem between their thumb and index finger in the concavity of the sidewalls along the stem. The head is wider than the stem to provide more of widthwise distance to apply cosmetics than would be afforded by a distance equal to the proximal end of the stem.

The distance across the width of the head may remain substantially uniform for the entire length of the head or slightly taper to narrow toward the distal ends of the outermost two of the applicator tips. The head therefore has a widthwise dimension that is substantially more uniform for a length of the head from the stem to distal ends of the applicator tips than a widthwise dimension across the stem for a length of the stem from the head to the proximal end. The length of the elliptical piece wedges 26 is longer than each of the stems and the elliptical piece wedges 26 each have two sidewalls each with a convex shape so as to diverge away from ends of the elliptical piece wedges 26. The convex shape complements the concave shape of the stem sidewalls that converge to the proximal end of the stem.

The head includes a base from which extends the applicator tips that each traverse a respective distance until terminating at associated ones of the distal ends. The respective distance may be either shorter than the length of the stem in the case of firm tipped cosmetic applicators, longer than the length of the stem in the case of soft tipped cosmetic applicators, or substantially as long as the length of the stem in the case of medium tipped cosmetic applicators.

While the foregoing description and drawings represent the preferred embodiments of the present invention, it will be understood that various changes and modifications may be made without departing from the scope of the present invention.

What is claimed is:

1. A foam applicator product, comprising a pad with separation lines that define contours of a plurality of abutting pairs of cosmetic applicators and contours of a plurality of wedges, neighboring ones of the abutting pairs of cosmetic applicators being separated from each other by a respective one of the wedges whose contour that faces the neighboring ones of the abutting pairs of the cosmetic applicators complements contours of the neighboring ones of the abutting pairs of the cosmetic applicators and face the respective wedge, each of the cosmetic applicators having a respective body defined by a stem and a head that are adjacent each other, the head having elongated applicator tips that are spaced apart from each other and extend away from the stem to terminate at distal ends, the stem having stem sidewalls that converge away from the head to terminate at a proximate end, the proximal end having a width across that is shorter than a width across the head, the proximal end of the stem of associated ones of the abutting pairs of the cosmetic applicators abutting each other, the wedges each having opposite wedge ends between which extend opposite wedge sidewalls, the opposite wedge sidewalls diverging outwardly from each of the opposite wedge ends, each of the cosmetic applicators being made of closed cell nonwoven material that tends to cling across the separation lines until being manually separated from each other, each of the wedges having a length that spans between the wedge ends and that is longer than individual ones of the stems that neighbor the wedges, each of the cosmetic applicators being deformable under manual force from a relaxed, non-tensioned state to a deformed, tensioned state and being configured because of the memory to resiliently return to the relaxed, non-tensioned state from the deformed, tensioned state once the manual force is removed.

2. The foam applicator product of 1, wherein the closed foam material is selected from a group consisting of styrene butadiene polymer synthetic foam and nitrile butadiene polymer synthetic foam.

3. The foam applicator product of 1, wherein the stem sidewalls are concavely curved, the wedge sidewalls being convexly curved.

4. The foam applicator product of claim 1, wherein the cosmetic applicators are hypoallergenic, biodegradable, antibacterial and latex free.

5. The foam applicator product of claim 1, wherein the applicator tips each have a concave curvature that varies in concavity across their depth, the depth extending between opposite faces of the applicator tips, each of the opposite faces being defined by a length extending in a direction of elongation of the applicator tips and by a width extending transverse to the length.

6. The foam applicator product of claim 1, wherein the stem has a length of less than one inch between the proximal end and the head.

7. The foam applicator product of claim 1, wherein the head includes a base from which extends the applicator tips that each traverse a respective distance until terminating at associated ones of the distal ends, the respective distance each being smaller than the length of the stem.

8. The foam applicator product of claim 1, wherein the head includes a base from which extends the applicator tips that each traverse a respective distance until terminating at associated ones of the distal ends, the respective distance each being longer than the length of the stem.

9. The foam applicator product of claim 1, wherein the head includes a base from which extends the applicator tips that each traverse a respective distance until terminating at associated ones of the distal ends, the respective distance each being substantially as long as the length of the stem.

10. The foam applicator product of claim 9, wherein the plurality of bodies are in a common package together with an insert that makes an indication of the cosmetic applicator as a function of a length of the applicator tips, the indication being selected from a group consisting of soft tipped, medium tipped and firm tipped.

* * * * *